US010966532B2

(12) United States Patent
Chen et al.

(10) Patent No.: US 10,966,532 B2
(45) Date of Patent: Apr. 6, 2021

(54) ROTATABLE ACCESSORY AND FOLDING CHAIR USING THE SAME

(71) Applicant: Libin Chen, Changzhou (CN)

(72) Inventors: Libin Chen, Changzhou (CN); Qinglei Kong, Changzhou (CN)

(73) Assignee: Libin Chen, Changzhou (CN)

( * ) Notice: Subject to any disclaimer, the term of this patent is extended or adjusted under 35 U.S.C. 154(b) by 0 days.

(21) Appl. No.: 16/858,635

(22) Filed: Apr. 26, 2020

(65) Prior Publication Data

US 2021/0052079 A1 Feb. 25, 2021

(30) Foreign Application Priority Data

Aug. 23, 2019 (CN) ..... 201921386040.9

(51) Int. Cl.

| | |
|---|---|
| ***A47B 83/02*** | (2006.01) |
| ***A47C 7/62*** | (2006.01) |
| ***A47C 7/70*** | (2006.01) |

(52) U.S. Cl.

CPC ..... *A47C 7/624* (2018.08); *A47C 7/70* (2013.01)

(58) Field of Classification Search

CPC ..... A47C 7/70; A47C 7/705; A47C 7/622; A47C 7/624; A47C 7/68; B64D 11/0638

See application file for complete search history.

(56) References Cited

U.S. PATENT DOCUMENTS

| | | | | | |
|---|---|---|---|---|---|
| 2,947,348 | A * | 8/1960 | Peckham | B64D 11/0646 | 297/145 |
| 2,994,366 | A * | 8/1961 | Hoch | A47C 7/70 | 248/230.1 |
| 3,166,354 | A * | 1/1965 | Sorensen | A47C 7/68 | 297/160 |
| 4,861,102 | A * | 8/1989 | Fuller | A47C 7/68 | 297/162 |
| 5,364,166 | A * | 11/1994 | Zegeer | A47C 7/541 | 297/411.39 |
| 5,547,247 | A * | 8/1996 | Dixon | A47C 7/70 | 297/145 |
| 5,649,737 | A * | 7/1997 | Behnke | A47C 7/70 | 297/170 |
| 5,709,155 | A * | 1/1998 | Terracciano | A47C 7/70 | 108/42 |
| 5,865,124 | A * | 2/1999 | Wroe | A47C 7/70 | 108/26 |

(Continued)

*Primary Examiner* — Shin H Kim

(74) *Attorney, Agent, or Firm* — Bayramoglu Law Offices LLC

(57) ABSTRACT

A rotatable accessory includes a table top and a flipping mechanism. The flipping mechanism includes a first connecting portion and a second connecting portion. A compression spring is arranged between one side of the first connecting portion and the second connecting portion. The first connecting portion and the second connecting portion are each provided with a first blind hole facing the compression spring. Both ends of the compression spring respectively extend into the two first blind holes and abut on the bottom surface of the first blind hole. The other side of the first connecting portion and the other second connecting portion are connected by a guide hole and a guide column. The rotatable accessory can be mounted on a chair or a bed to allow users to place portable small objects such as mobile phones and cups on the rotatable accessory.

13 Claims, 10 Drawing Sheets

(56) References Cited

U.S. PATENT DOCUMENTS 5,899,526 A * 5/1999 LaPointe ..... A47C 7/70 297/173
6,224,149 B1 * 5/2001 Gevaert ..... A47C 7/70 297/160
6,375,257 B1 * 4/2002 Wooding ..... A47C 7/70 248/218.4
7,478,868 B2 * 1/2009 Figueras Mitjans ..... A47C 7/70 297/145
8,113,128 B2 * 2/2012 Lee ..... A47C 7/705 108/42
8,905,471 B2 * 12/2014 Tang ..... A47C 5/10 297/173
8,979,190 B2 * 3/2015 Madrigal ..... A47C 7/622 297/162
10,625,650 B1 * 4/2020 Spencer ..... B64D 11/0644
2006/0103182 A1 * 5/2006 Augustine ..... A61G 7/103 297/173
2006/0145519 A1 * 7/2006 Hardt, II ..... A47B 85/04 297/124
2008/0265632 A1 * 10/2008 Le ..... A47C 1/04 297/173
2011/0017103 A1 * 1/2011 Lee ..... A47C 7/70 108/42
2012/0223548 A1 * 9/2012 Sharber ..... A47C 7/622 297/161
2014/0225402 A1 * 8/2014 Dehli ..... A47C 7/70 297/173
2015/0157517 A1 * 6/2015 Okada ..... A61G 5/1094 108/44
2015/0241041 A1 * 8/2015 Youngberg ..... A47C 7/624 362/249.1
2015/0359332 A1 * 12/2015 Yang ..... A47C 7/622 297/173
2018/0229848 A1 * 8/2018 Murray ..... B64D 11/0638
2018/0281299 A1 * 10/2018 Maslakow ..... B64D 11/0638
2018/0338622 A1 * 11/2018 Doolan ..... A47C 4/20
2018/0338623 A1 * 11/2018 Winterhalter ..... A47C 4/20
2019/0313799 A1 * 10/2019 Frankel ..... A47C 7/70

* cited by examiner

ROTATABLE ACCESSORY AND FOLDING CHAIR USING THE SAME

CROSS REFERENCE TO THE RELATED APPLICATIONS

This application is based upon and claims priority to Chinese Patent Application No. 201921386040.9, filed on Aug. 23, 2019, the entire contents of which are incorporated herein by reference.

TECHNICAL FIELD

The present disclosure relates to the technical field of furniture, and particularly to a rotatable accessory and a folding chair using the rotatable accessory.

BACKGROUND

A chair is a type of seat with a backrest (and an armrest), and a bed is a type of bedding. At present, users have nowhere to place objects such as mobile phones, cups or keys when using the chair or bed without a table, which causes the users much inconvenience. In the prior art, some chairs or beds are provided with table tops for use, however, most of these table tops cannot be folded and stored.

Therefore, it is imperative to improve the technical solutions in the prior art.

SUMMARY

In order to solve the technical problem that the table top arranged on the chair or bed in the prior art cannot be folded, the present disclosure provides a rotatable accessory and a folding chair using the accessory to solve the above-mentioned problem.

The present disclosure adopts the following technical solution to solve this technical problem. A rotatable accessory includes:

a table top and a flipping mechanism. The flipping mechanism includes a first connecting portion and a second connecting portion. The first connecting portion is fixedly connected to the table top or the second connecting portion is fixedly connected to the table top.

Each of the two sides of the first connecting portion is provided with the second connecting portion.

A compression spring is arranged between one side of the first connecting portion and the second connecting portion. The first connecting portion and the second connecting portion are each provided with a first blind hole facing the compression spring. Both ends of the compression spring respectively extend into the two first blind holes and abut on the bottom surface of the first blind hole.

The other side of the first connecting portion and the other second connecting portion are connected by a guide hole and a guide column. The guide hole is formed on the first connecting portion, and the guide column is fixed on the second connecting portion. Alternatively, the guide hole is formed on the second connecting portion, and the guide column is fixed on the first connecting portion.

The guide column extends into the guide hole and is slidably matched with the guide hole. When the guide column slides out of the guide hole and rotates around the axis of the guide column by an angle A, the guide column can still extend into the guide hole to be slidably matched with the guide hole. The angle A is more than 0 degrees and less than 360 degrees.

When the guide column is slidably matched with the guide hole, the inner wall of the guide hole is matched with the outer wall of the guide column to prevent the guide column from rotating around the axis of the guide column.

Preferably, the flipping mechanism further includes a rotating shaft.

The first connecting portion, the second connecting portion and the guide column are each provided with a first through-hole.

The first connecting portion, the second connecting portion and the guide column are rotatably sleeved on the rotating shaft through the first through-holes, and the compression spring is also sleeved on the rotating shaft.

Preferably, the flipping mechanism further includes two plugs, wherein the two plugs abut on both ends of the rotating shaft, respectively. A plug hole is formed on the two second connecting portions that are located on the outermost side, and the two plugs are plugged in the plug hole.

Preferably, the flipping mechanism further includes a fixing portion, and a clamping groove is recessed into the bottom of the fixing portion.

The second connecting portion is integrated with the edge of the table top to form one piece.

A second mounting portion protrudes upward from the first connecting portion. A plurality of mounting grooves are recessed into the second mounting portion, and a protruding portion protrudes from the inner wall of the clamping groove and is engaged with the mounting groove.

The protruding portion is embedded in the mounting groove. The second mounting portion and the fixing portion are fixed by screws.

Preferably, a first inserting groove and a second inserting groove are recessed into the top surface of the table top, wherein the first inserting groove is configured to receive a mobile phone, and the second inserting groove is configured to receive a cup.

The present disclosure further provides a folding chair including the rotatable accessory as mentioned above.

The folding chair is provided with an armrest rod.

The second connecting portion is integrated with the edge of the table top to form one piece. A first mounting portion protrudes from the first connecting portion, and the first mounting portion is fixedly connected to the armrest rod.

The present disclosure further provides a folding chair including the rotatable accessory as mentioned above.

The folding chair is provided with an armrest rod.

The clamping groove is clamped on the armrest rod.

An inserting column protrudes downward from the inner wall of the clamping groove. An inserting hole is formed on the armrest rod and engaged with the inserting column. When the clamping groove is clamped on the armrest rod, the inserting column is inserted in the inserting hole.

Preferably, the folding chair includes two side frames arranged opposite to each other, and the folding chair further includes a linkage mechanism provided between the two side frames. The linkage mechanism is fixedly connected to the two side frames to allow the two side frames to be away from each other and close to each other under the action of an external force.

The side frame includes a first support rod, a second support rod, the armrest rod, and a first connecting rod.

The upper end of the first support rod is fixed to the armrest rod extending backward, and a backrest rod extends upward from an end of the armrest rod away from the first support rod.

The upper end of the second support rod is fixedly connected to the backrest rod.

The height of the first connecting rod is lower than the height of the armrest rod. A first end portion of the first connecting rod is fixedly connected to the first support rod, and a second end portion of the first connecting rod extends backward and is fixedly connected to the second support rod.

Preferably, the linkage mechanism includes two cross mechanisms, wherein the cross mechanism includes two first linkage rods, and the two first linkage rods are hinged by a first hinge shaft. The first hinge shaft is located in the middle of the first linkage rod, and a second linkage rod is hinged on the first linkage rod. A first end portion of the second linkage rod is hinged to the first linkage rod by a second hinge shaft. The second hinge shaft is closer to the upper end of the first linkage rod than the first hinge shaft is to the upper end of the first linkage rod.

In one of the two side frames, the first support rod is hinged to a second end portion of a second linkage rod on a first linkage rod in one of the two cross mechanisms by a third hinge shaft. The first support rod is further hinged to the lower end of the other first linkage rod by a fourth hinge shaft. The second support rod is hinged to a second end portion of a second linkage rod on a first linkage rod in the other cross mechanisms by a fifth hinge shaft. The second support rod is further hinged to the lower end of the other first linkage rod by a sixth hinge shaft.

The third hinge shaft is closer to the upper end of the first support rod than the fourth hinge shaft is to the upper end of the first support rod, and the fifth hinge shaft is closer to the upper end of the second support rod than the sixth hinge shaft is to the upper end of the second support rod.

The upper ends of the two first linkage rods hinged on the same side frame are connected by a first horizontal rod.

Preferably, the side frame further includes a support portion.

A third connecting portion bent upward is fixed to a first end portion of the support portion. The third connecting portion is integrated with the support portion to form one piece. An end of the third connecting portion away from the support portion is fixedly connected to the first connecting rod.

The lower end of the first support rod forms a first support leg, and the lower end of the second support rod forms a second support leg. The second end portion of the support portion extends backward to the rear of the second support leg.

The first support leg and the bottom surface of the support portion are located at the same height, and the second support leg abuts on the support portion.

The present disclosure has the following advantages. The rotatable accessory can be mounted on a chair or a bed to allow users to place portable small objects such as mobile phones and cups on the rotatable accessory. Moreover, this rotatable accessory can be conveniently folded to reduce occupying space when not in use.

BRIEF DESCRIPTION OF THE DRAWINGS

The present disclosure will be further described hereinafter with reference to the drawings and embodiments.

Figure 1:
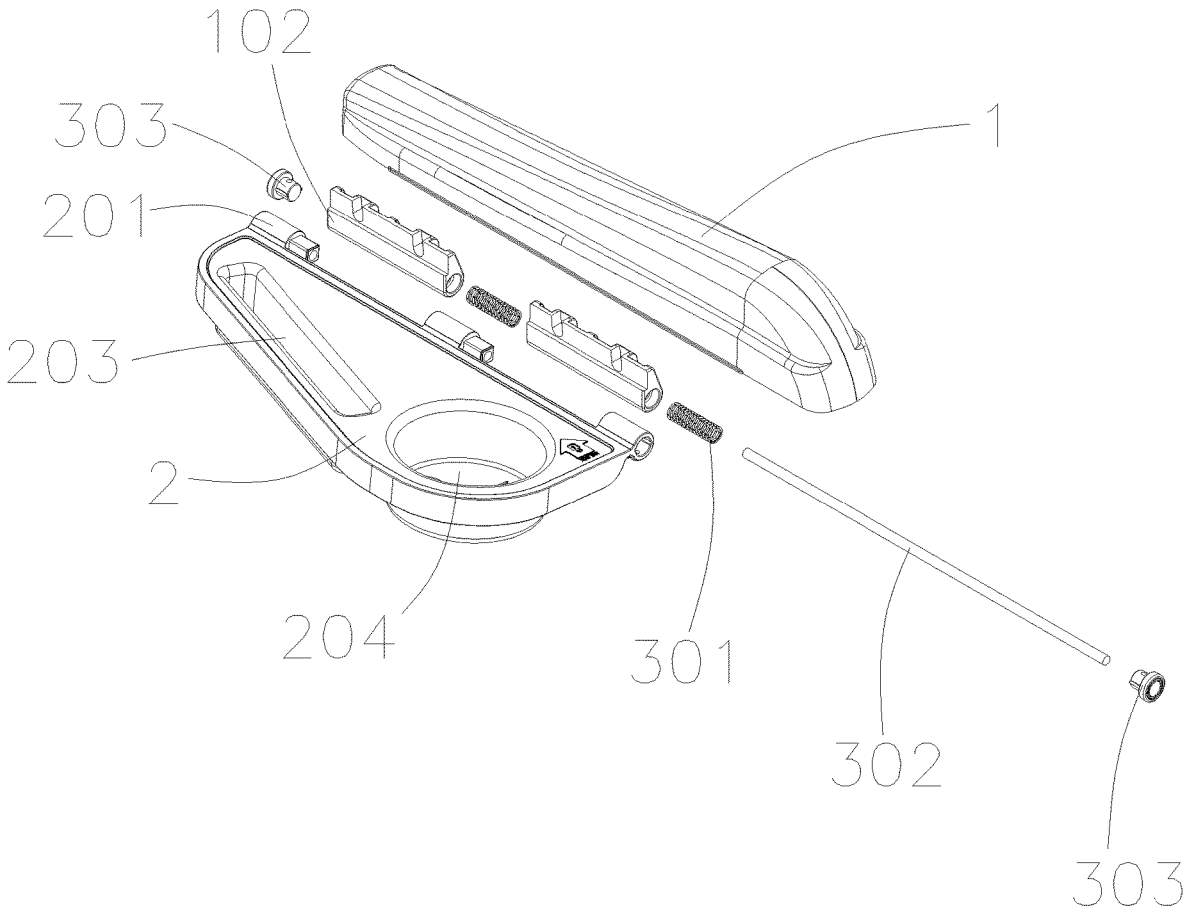
FIG. 1 is an exploded view of the rotatable accessory of the present disclosure.

In the drawings: 1, fixing portion; 101, clamping groove; 102, first connecting portion; 103, first blind hole; 104, second mounting portion; 105, mounting groove; 106, protruding portion; 107, inserting column, 108, first mounting portion; 2, table top; 201, second connecting portion; 202, guide column; 203, first inserting groove; 204, second inserting groove; 205, plug hole; 301, compression spring; 302, rotating shaft; 303, plug; 304, first through-hole; 401, first support rod; 402, second support rod; 403, armrest rod; 404, first connecting rod; 405, backrest rod; 501, first linkage rod; 502, second linkage rod; 503, first horizontal rod; 601, support portion; 602, third connecting portion.

DETAILED DESCRIPTION OF THE EMBODIMENTS

The embodiments of the present disclosure will be described in detail hereinafter and shown in the drawings, wherein the same or similar reference numerals denote the same or similar elements or elements having the same or similar functions throughout. The illustrative embodiments described hereinafter with reference to the drawings are only intended to illustrate the present disclosure and should not be construed as limiting the present disclosure.

In the description of the present disclosure, it should be noted that the directions or positional relations indicated by the terminologies "center", "longitudinal", "transverse", "length", "width", "thickness", "upper", "lower", "front", "back", "left", "right", "vertical", "horizontal", "top", "bottom", "inside", "outside", "axial", "radial", "circumferential" and the like, are based on the directions or positional relations shown in the drawings and are only intended to facilitate describing the present disclosure and simplifying the description, rather than indicating or implying that the specified device or element must be constructed and operated in a specific orientation. Therefore, these directions or positional relations cannot be construed as a limitation on the present disclosure.

Furthermore, the terminologies "first", "second" and the like, are used only for descriptive purposes and cannot be construed as being indicative or suggestive of relative importance. In the description of the present disclosure, it should be noted that, unless otherwise specified and defined, the terminology "connected" shall be understood in a broad sense. For example, the terminology "connected" can denote a fixed connection, a detachable connection or an integral connection, a mechanical connection or an electrical connection, and a direct connection or an indirect connection through an intermediate medium. The specific definitions of the above-mentioned terminologies in the present disclosure can be understood by those having ordinary skill in the art according to the specific circumstance. In addition, in the description of the present disclosure, unless otherwise stated, the definition of "plurality of" indicates two or more.

Figure 2:
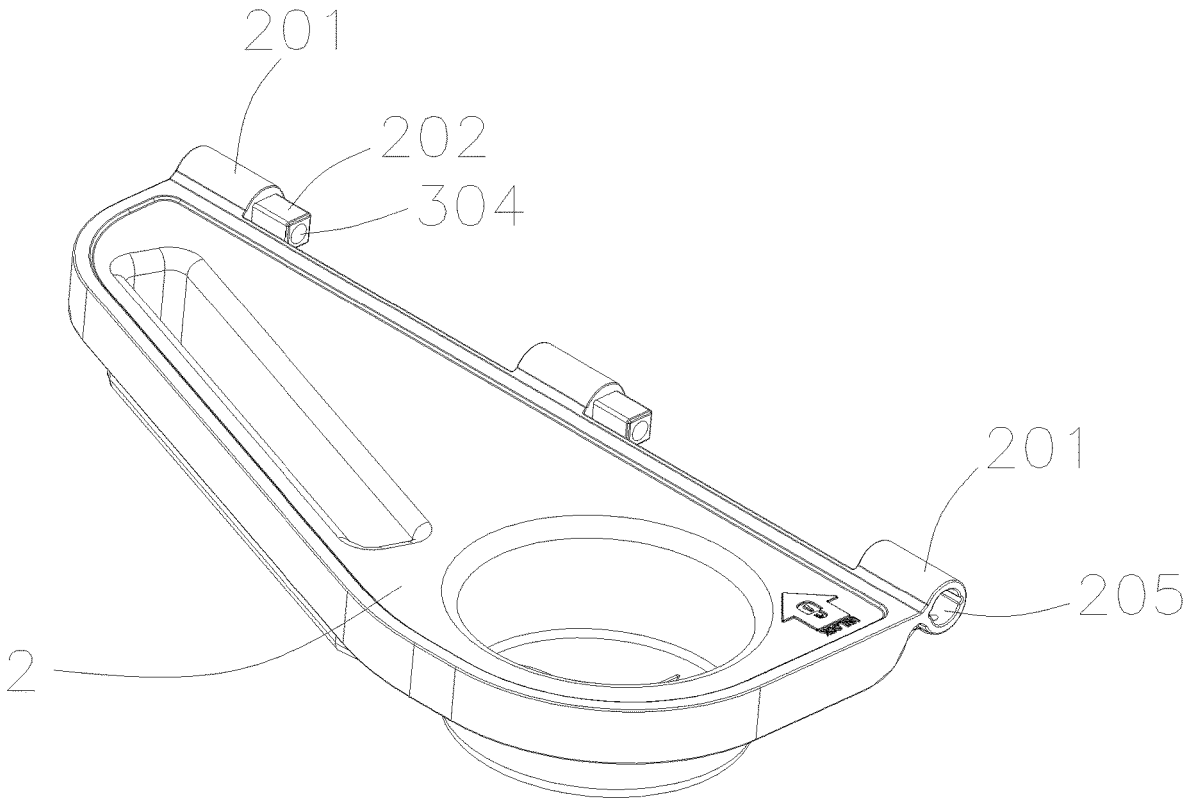
FIG. 2 is a structural schematic diagram showing the table top according to an embodiment of the rotatable accessory of the present disclosure.
Figure 3:
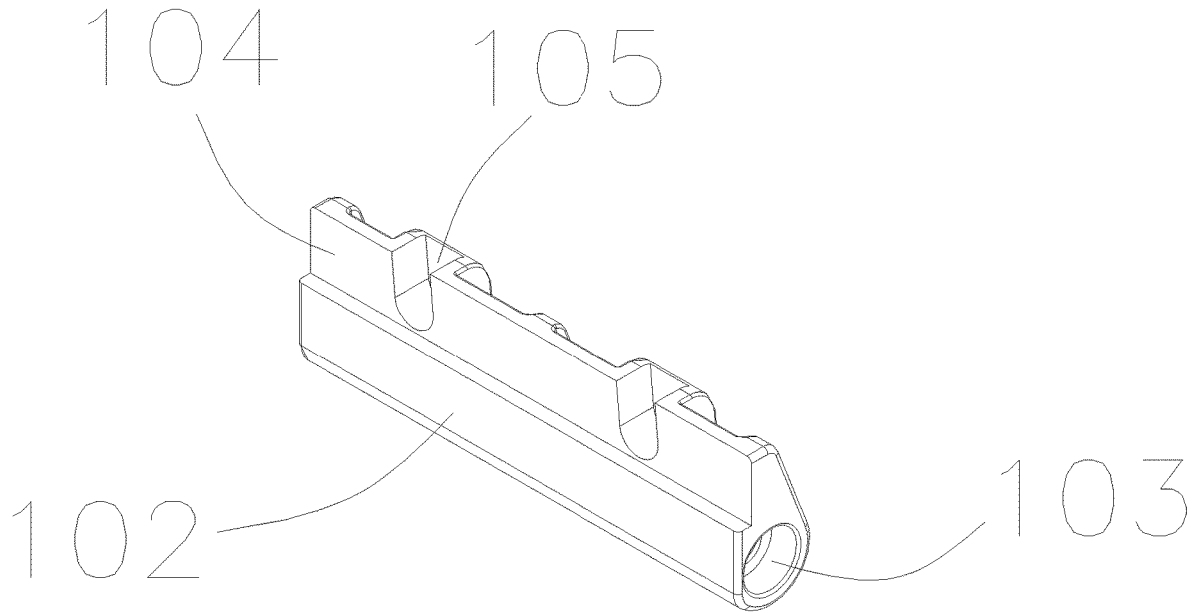
FIG. 3 is a structural schematic diagram showing the first connecting portion according to an embodiment of the rotatable accessory of the present disclosure.
Figure 4:
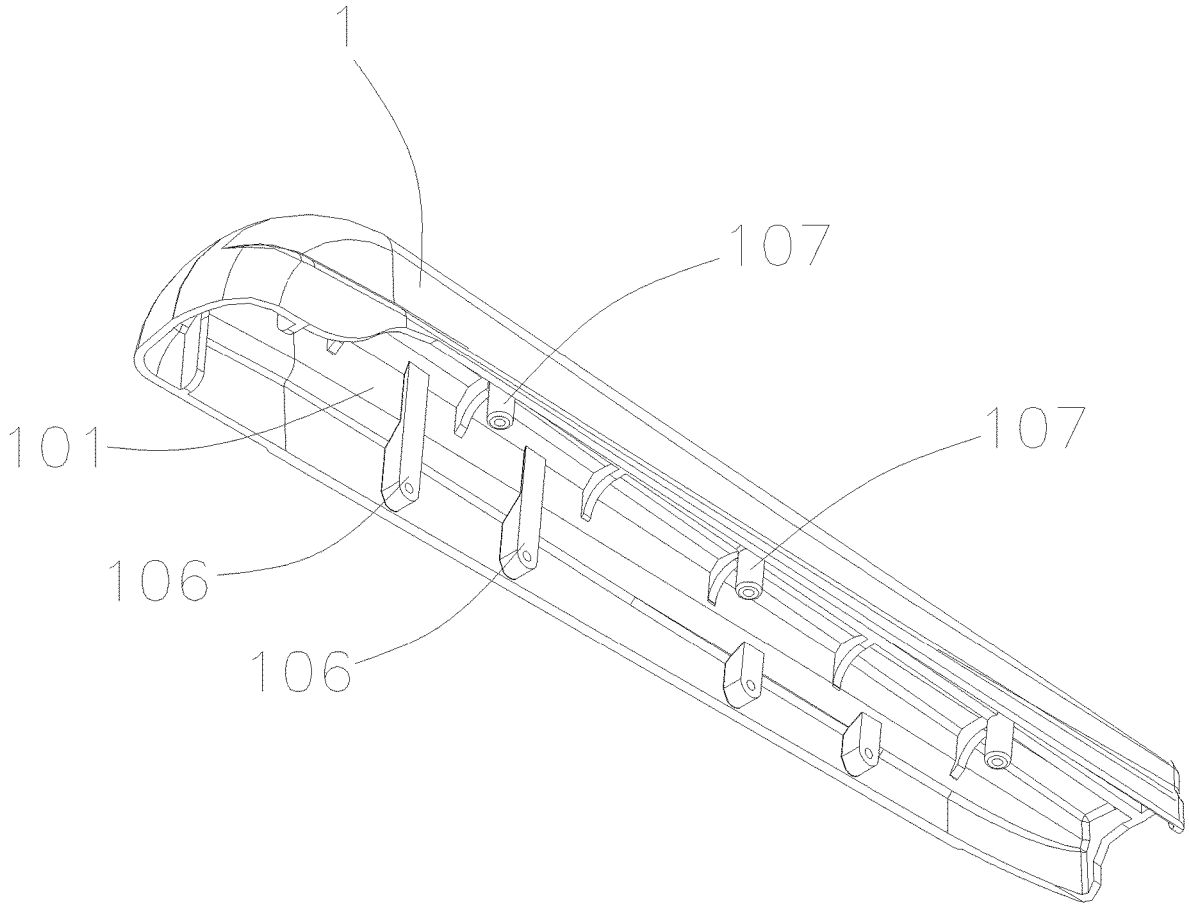
FIG. 4 is a structural schematic diagram showing the fixing portion according to an embodiment of the rotatable accessory of the present disclosure.
Figure 5:
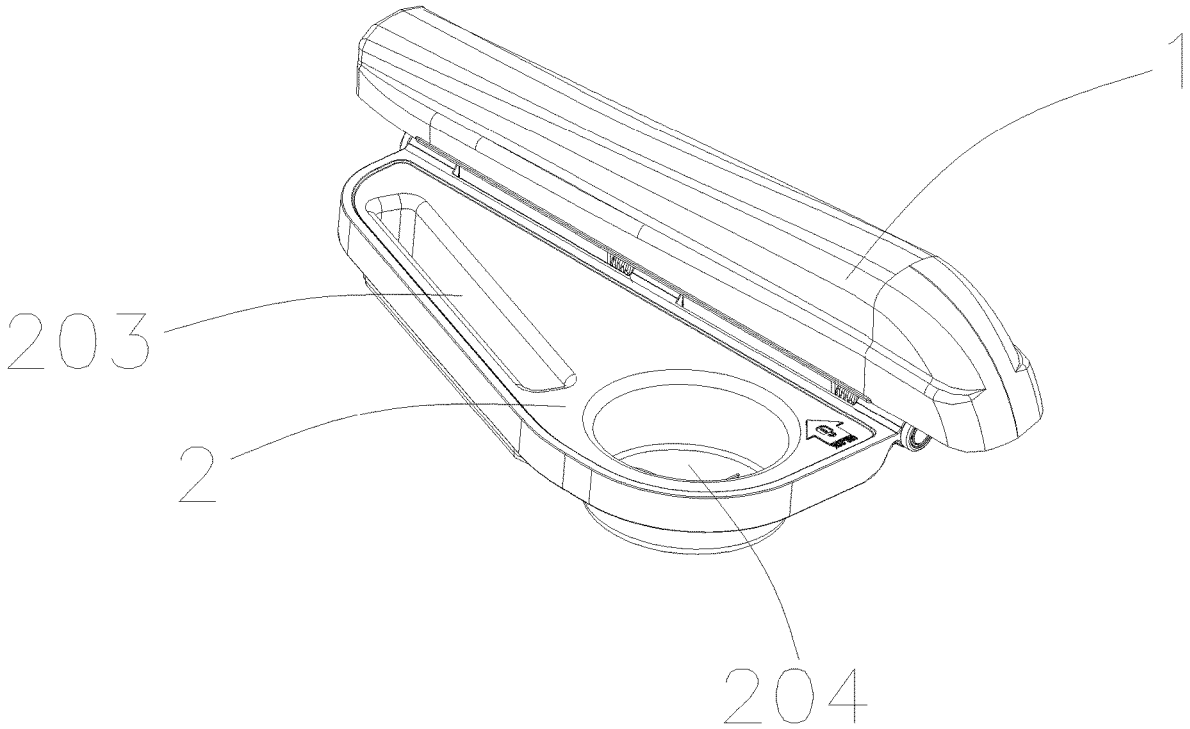
FIG. 5 is a schematic diagram showing the rotatable accessory during use according to an embodiment of the present disclosure.
Figure 6:
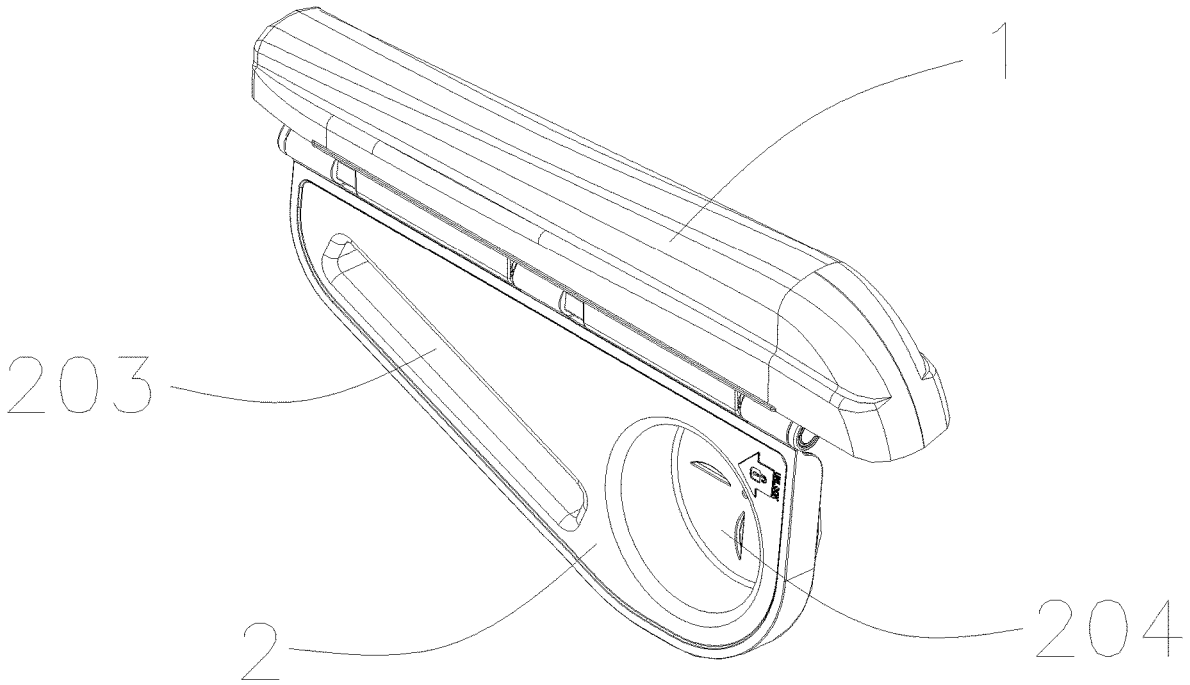
FIG. 6 is a schematic diagram showing a folded state of the rotatable accessory according to an embodiment of the present disclosure.

As shown in FIGS. 1-6, the present disclosure provides a rotatable accessory, including:

the table top 2 and a flipping mechanism. The flipping mechanism includes the first connecting portion 102 and the second connecting portion 201. The first connecting portion 102 is fixedly connected to the table top 2 or the second connecting portion 201 is fixedly connected to the table top 2. In other words, if the first connecting portion 102 is fixedly connected to the table top 2, the second connecting portion 201 is fixedly connected to an object on which the rotatable accessory needs to be mounted; if the second connecting portion 201 is fixedly connected to the table top 2, the first connecting portion 102 is fixedly connected to the object on which the rotatable accessory needs to be mounted.

Each of the two sides of the first connecting portion 102 is provided with the second connecting portion 201.

The compression spring 301 is arranged between one side of the first connecting portion 102 and the second connecting portion 201. The first connecting portion 102 and the second connecting portion 201 are each provided with a first blind hole facing the compression spring 301. Both ends of the compression spring 301 respectively extend into the two first blind holes and abut on the bottom surface of the first blind hole.

The other side of the first connecting portion 102 and the other second connecting portion 201 are connected by the guide hole and the guide column 202. If the guide hole is formed on the first connecting portion 102, the guide column 202 is fixed on the second connecting portion 201. If the guide hole is formed on the second connecting portion 201, the guide column 202 is fixed on the first connecting portion 102.

The guide column extends into the guide hole to be slidably matched with the guide hole. When the guide column slides out of the guide hole and rotates around the axis of the guide column by an angle A, the guide column can still extend into the guide hole to be slidably matched with the guide hole. The angle A is more than 60 degrees and less than 120 degrees, and is preferably 90 degrees.

When the guide column is slidably matched with the guide hole, the inner wall of the guide hole is matched with the outer wall of the guide column to prevent the guide column from rotating around the axis of the guide column.

The first inserting groove 203 and the second inserting groove 204 are recessed into the top surface of the table top 2. The first inserting groove 203 is configured to receive a mobile phone, and the second inserting groove 204 is configured to receive a cup. The cross section of the first inserting groove 203 is in an elongated shape matched with the mobile phone, and the cross section of the second inserting groove 204 is in a circular shape matched with the cup.

The process of using the rotatable accessory is as follows:

The rotatable accessory is mounted on an object as needed, e.g., a table or bed. When the rotatable accessory is in use, the table top 2 is in a horizontal state. At this time, the first connecting portion 102 and the second connecting portion 201 provided with the guide column 202 and the guide hole abut on each other under the action of the compression spring 301, and the guide column extends into the guide hole. As a result, the table top 2 cannot be rotated. In this state, small objects can be placed on the top surface of the table top 2, a mobile phone can be inserted in the first inserting groove 203, and a cup can be placed in the second inserting groove 204.

The table top 2 is moved to further compress the compression spring 301, so that the first connecting portion 102 and the second connecting portion 201 provided with the guide column 202 and the guide hole are away from each other, until the guide column 202 slides out of the guide hole, and then the table top 2 is rotated downward around the axis of the guide column 202. After that, the guide column 202 slides into the guide hole again. The first connecting portion 102 and the second connecting portion 201 provided with the guide column 202 and the guide hole abut on with each other under the action of the compression spring 301. At this time, the table top 2 cannot be rotated, the table top 2 is in the vertical or approximately vertical state, and the rotatable accessory is in the folded state.

In a specific embodiment, the guide column 202 is a square column, and the guide hole is a square hole matched with the square column. When the square column is inserted into the square hole, the square column cannot rotate around the axis of the square column. After the square column slides out of the square hole and rotates around the axis of the square column by 90 degrees, the square column can be inserted into the square hole again. After the square column is inserted, the square column cannot rotate around the axis of the square column.

In a specific embodiment, the flipping mechanism further includes the rotating shaft 302. The first connecting portion 102, the second connecting portion 201 and the guide column 202 are all provided with the first through-hole 304. The first connecting portion 102, the second connecting portion 201 and the guide column 202 are rotatably sleeved on the rotating shaft 302 through the first through-hole 304, and the compression spring 301 is also sleeved on the rotating shaft 302. In this way, when the table top 2 is turned over, the compression spring 301, the first connecting portion 102 and the second connecting portion 201 are not disengaged or separated, thereby maintaining the stability of the entire flipping mechanism.

The flipping mechanism further includes two plugs 303, and the two plugs 303 abut on the two ends of the rotating shaft 302, respectively. The plug hole 205 is formed in each of two connecting portions 201 that are located on the outermost side, and the two plugs 303 are inserted into the plug hole 205. The two plugs 303 can abut on the two ends of the rotating shaft 302 to prevent the rotating shaft 302 from sliding out of the first through-hole 304.

In a specific embodiment, the flipping mechanism further includes the fixing portion 1, and the clamping groove 101 is recessed in the bottom of the fixing portion 1. The clamping groove 101 is configured to clamp an object on which the rotatable accessory needs to be mounted. The second connecting portion 201 is integrated with the edge of the table top 2 to form one piece. The second mounting portion 104 protrudes upward from the first connecting portion 102. The plurality of mounting grooves 105 are recessed in the second mounting portion 104. The protruding portion 106 matched with the mounting groove 105 protrudes from the inner wall of the clamping groove 101. The protruding portion 106 is embedded in the mounting groove 105. The second mounting portion 104 and the fixing portion 1 are fixed by screws. Specifically, the protruding portion 106 is provided with a blind threaded hole, the second mounting portion 104 is provided with a threaded through-hole, and the screw is screwed through the threaded through-hole and screwed into the threaded blind hole to fixedly connect the second mounting portion 104 to the fixing portion 1.

Figure 7:
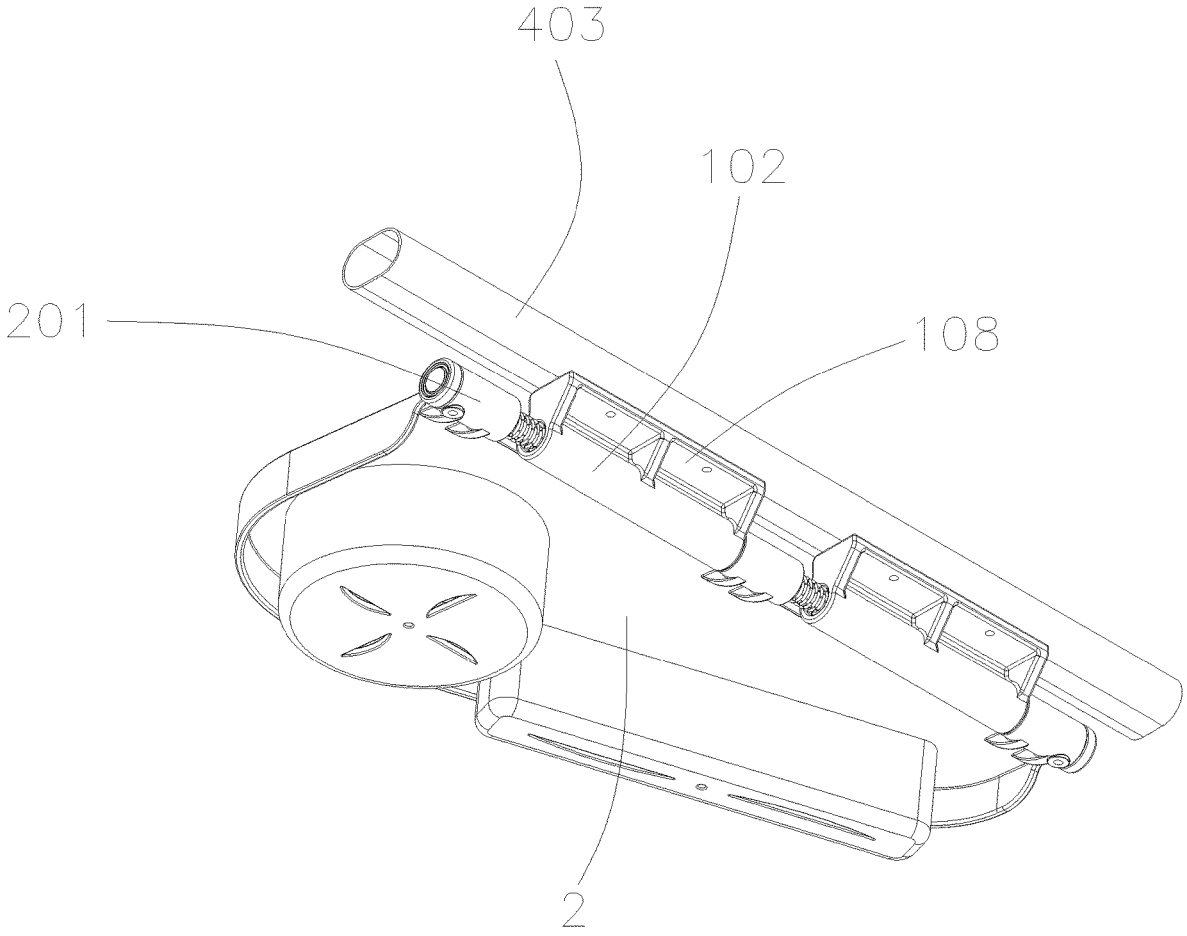
FIG. 7 is a partial structural schematic diagram showing the rotatable accessory and the armrest rod of the folding chair according to an embodiment of the present disclosure.
Figure 8:
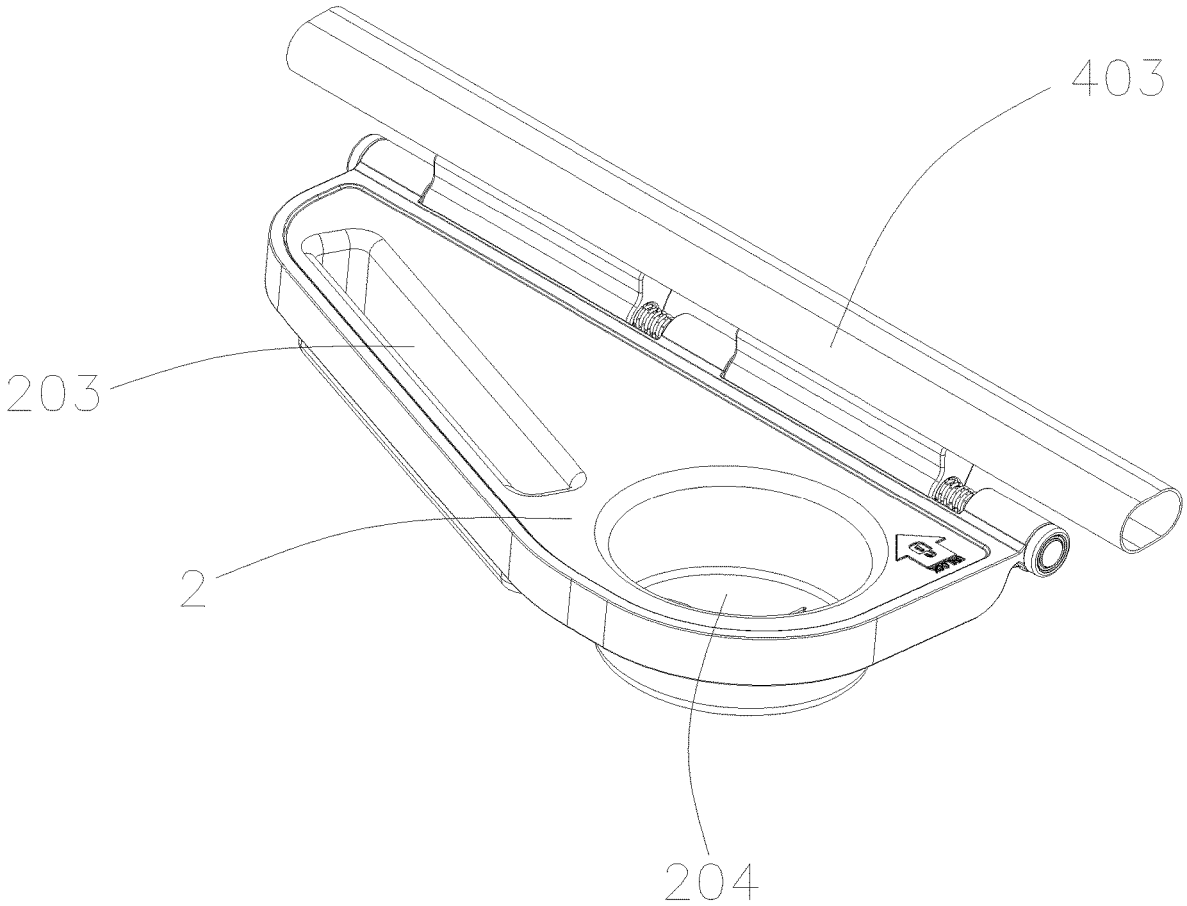
FIG. 8 is a partial structural schematic diagram showing the rotatable accessory, the first inserting groove and the second inserting groove during use according to an embodiment of the present disclosure.
Figure 9:
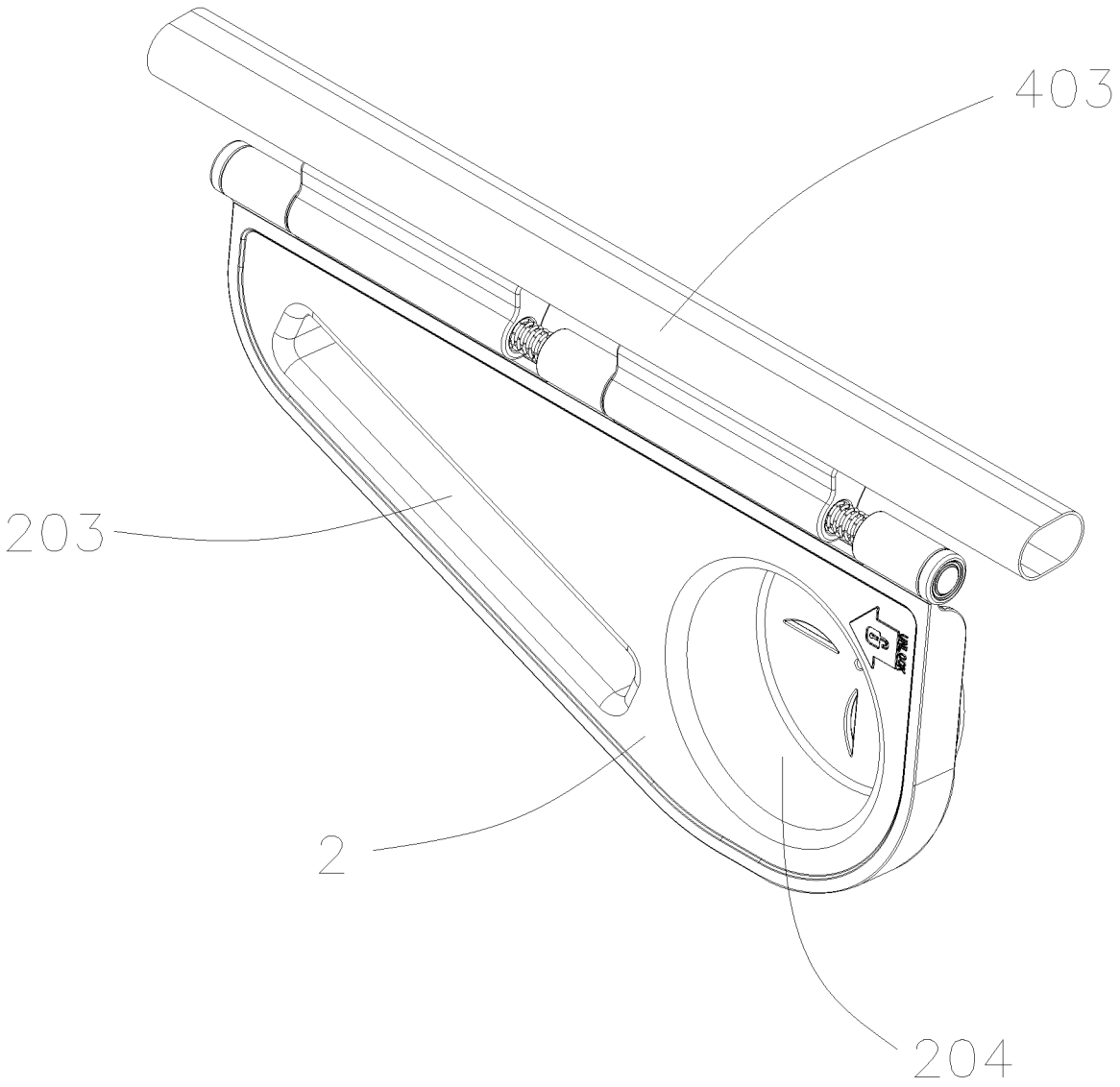
FIG. 9 is a partial structural schematic diagram showing the rotatable accessory, the first inserting groove and the second inserting groove in the folded state according to an embodiment of the present disclosure.
Figure 10:
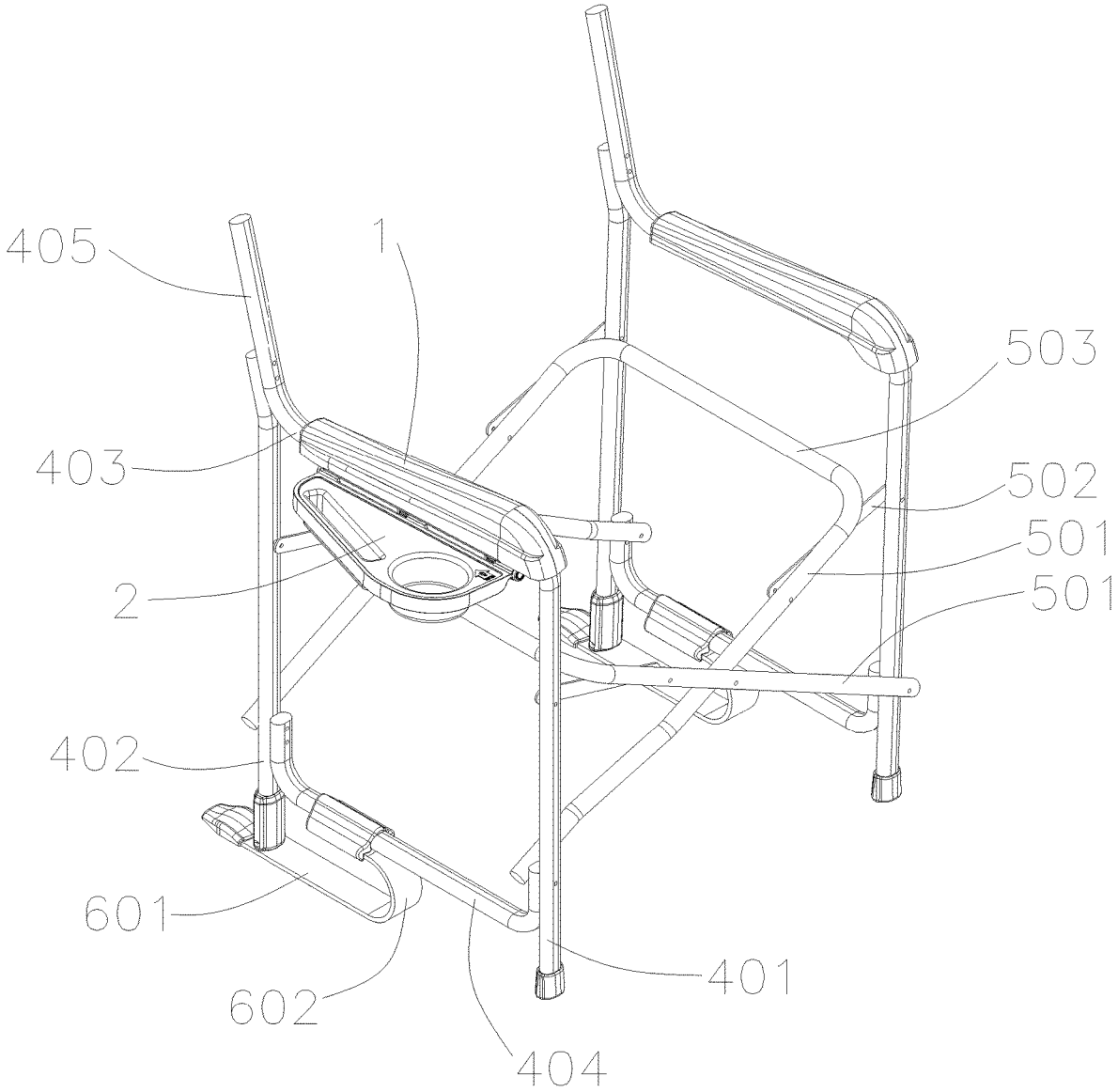
FIG. 10 is a partial structural schematic diagram of the folding chair according to another embodiment of the present disclosure.

As shown in FIGS. 7-10, the present disclosure further provides a folding chair including the rotatable accessory as described above.

The folding chair includes the armrest rod 403. The second connecting portion 201 is integrated with the edge of the table top 2 to form one piece, and the first connecting portion 102 is fixedly connected to the armrest rod 403 of the folding chair.

In a specific embodiment, the first connecting portion 102 is fixedly connected to the armrest rod 403 by the first mounting portion 108. The first mounting portion 108 protrudes from the first connecting portion 102. The first mounting portion 108 and the armrest rod 403 are fixed by screws. Specifically, the first mounting portion 108 is provided with a threaded through-hole, the armrest rod 403 is provided with a threaded blind hole, and the screw is screwed through the threaded through-hole and screwed into the threaded blind hole to fix the first mounting portion 108 and the armrest rod 403.

In a specific embodiment, the first connecting portion 102 is fixedly connected to the armrest rod 403 by the second mounting portion 104 and the fixing portion 1. The clamping groove 101 is clamped on the armrest rod 403. The inserting column 107 protrudes downward from the inner wall of the clamping groove 101. The armrest rod 403 is provided with an inserting hole matched with the inserting column 107. When the clamping groove 101 is clamped on the armrest rod 403, the inserting column 107 is inserted in the inserting hole.

The inserting column 107 and the inserting hole are matched with each other to limit clamping groove 101 and the armrest rod 403, so that the fixing portion 1 is securely clamped on the armrest rod 403 through the clamping groove 101.

In a specific embodiment, the folding chair includes two side frames arranged opposite to each other. The folding chair further includes a linkage mechanism, and the linkage mechanism is arranged between the two side frames.

The side frame includes the first support rod 401, the second support rod 402, the armrest rod 403, and the first connecting rod 404.

The upper end of the first support rod 401 is fixed to the armrest rod 403 extending backward, and the backrest rod 405 extends upward from the end of the armrest rod 403 away from the first support rod 401.

The upper end of the second support rod 402 is fixedly connected to the backrest rod 405.

The height of the first connecting rod 404 is lower than the height of the armrest rod 403. The first end portion of the first connecting rod 404 is fixedly connected to the first support rod 401, and the second end portion of the first connecting rod 404 extends backward and is fixedly connected to the second support rod 402.

The linkage mechanism includes two cross mechanisms, wherein the cross mechanism includes two first linkage rods 501, and the two first linkage rods 501 are hinged by the first hinge shaft. The first hinge shaft is located in the middle of the first linkage rod 501, and the second linkage rod 502 is also hinged on the first linkage rod 501. The first end portion of the second linkage rod 502 is hinged to the first linkage rod 501 by the second hinge shaft. The second hinge shaft is closer to the upper end of the first linkage rod 501 than the first hinge shaft is to the upper end of the first linkage rod 501.

In one of the two side frames, the first support rod 401 is hinged to the second end portion of the second linkage rod 502 on the first linkage rod 501 in one of the two cross mechanisms by the third hinge shaft. The first support rod is further hinged to the lower end of the other first linkage rod 501 by the fourth hinge shaft. The second support rod 402 is hinged to the second end portion of the second linkage rod 502 on the first linkage rod 501 in the other cross mechanisms by the fifth hinge shaft. The second support rod is further hinged to the lower end of the other first linkage rod 501 by the sixth hinge shaft.

The third hinge shaft is closer to the upper end of the first support rod 401 than the fourth hinge shaft is to the upper end of the first support rod 401, and the fifth hinge shaft is closer to the upper end of the second support rod 402 than the sixth hinge shaft is to the upper end of the second support rod 402.

The upper ends of the two first linkage rods 501 hinged on the same side frame are connected by the first horizontal rod 503.

When the two side frames are forced to move toward each other, the lower ends of the two first linkage rods 501 in the cross mechanism are gradually closely approach each other, and the cross mechanism is accordingly folded, thereby folding the entire folding chair. In contrast, the two side frames can be separated from each other to unfold the entire folding chair.

The folding chair is combined with the rotatable table on the armrest side. In this way, the folding chair provided with this rotatable accessory occupies less space and is easy to carry after being folded.

In a specific embodiment, the side frame further includes the support portion 601.

The third connecting portion 602 bent upward is fixed to the first end portion of the support portion 601. The third connecting portion 602 is integrated with the support portion 601 to form one piece. The end of the third connecting portion 602 away from the support portion 601 is fixedly connected to the first connecting rod 404.

The lower end of the first support rod 401 forms the first support leg, and the lower end of the second support rod 402 forms the second support leg. The second end portion of the support portion 601 extends backward to the rear of the second support leg.

The first support leg is located at the same height as the bottom surface of the support portion 601, and the second support leg abuts on the support portion 601.

The support portion 601 and the first support leg of the folding chair are in contact with the ground, which enlarges the contact area and improves the stability of the chair.

In the description of the specification, the reference terminologies "an embodiment", "some embodiments", "an example", "a specific embodiment", or "some examples", and the like, indicate that the specific features, structures, materials, or features described in conjunction with the embodiment or example are contained in at least one embodiment or example of the present disclosure. In this specification, the illustrative representation of these terminologies does not necessarily refer to the same embodiment or example. Furthermore, the specific features, structures, materials, or features described may be combined in a suitable manner in any one or more embodiments or examples.

Based on the teachings of the preferred embodiments of the present disclosure and the foregoing description, those skilled in the art can make various changes and modifications without departing from the technical idea of the present disclosure. The technical scope of the present disclosure is not limited to the contents in the description and must be subject to the scope of the appended claims.

What is claimed is:

1. A rotatable accessory, comprising:

a table top, and a flipping mechanism;

wherein the flipping mechanism comprises a first connecting portion and at least two second connecting portions; the first connecting portion is fixedly connected to the table top or the at least two second connecting portions are fixedly connected to the table top;

a front side and a rear side of the first connecting portion are respectively provided with a front second connecting portion and a rear second connecting portion of the at least two second connecting portions;

a compression spring is arranged between the front side of the first connecting portion and the front second connecting portion; the first connecting portion and the front second connecting portion are each provided with a first blind hole, wherein the first blind hole faces the compression spring; both ends of the compression spring respectively extend into the first blind hole and abut on a bottom surface of the first blind hole;

the rear side of the first connecting portion and the rear second connecting portion are connected by a guide hole and a guide column; the guide hole is formed on the first connecting portion, and the guide column is fixed on the rear second connecting portion; or the guide hole is formed on the second connecting portion, and the guide column is fixed on the first connecting portion;

the guide column extends into the guide hole and is slidably matched with the guide hole; wherein when the guide column slides out of the guide hole and rotates around an axis of the guide column by an angle, the guide column extends into the guide hole to be slidably matched with the guide hole; the angle is more than 0 degrees and less than 360 degrees; and when the guide column is slidably matched with the guide hole, an inner wall of the guide hole is matched with an outer wall of the guide column to prevent the guide column from rotating around the axis of the guide column.

2. The rotatable accessory according to claim 1, wherein, the flipping mechanism further comprises a rotating shaft;

each of the first connecting portion, the second connecting portion and the guide column is provided with a first through-hole; and the first connecting portion, the at least two second connecting portions and the guide column are rotatably sleeved on the rotating shaft through the first through-hole, and the compression spring is sleeved on the rotating shaft.

3. The rotatable accessory according to claim 2, wherein, the flipping mechanism further comprises two plugs; the two plugs abut on both ends of the rotating shaft, respectively; a plug hole is formed on each of two second connecting portions of the at least two second connecting portions, wherein the two second connecting portions are located on an outermost side, and the two plugs are plugged in the plug hole.

4. The rotatable accessory according to claim 3, wherein, the flipping mechanism further comprises a fixing portion, and a bottom of the fixing portion is provided with a clamping groove;

the at least two second connecting portions are integrated with an edge of the table top to form one piece;

a second mounting portion protrudes upward from the first connecting portion; the second mounting portion is provided with a plurality of mounting grooves; a plurality of protruding portions protrude from an inner wall of the clamping groove and are engaged with the plurality of mounting grooves; and the plurality of protruding portions are embedded in the plurality of mounting grooves; the second mounting portion and the fixing portion are fixed by a plurality of screws.

5. The rotatable accessory according to claim 4, wherein, a top surface of the table top is provided with a first inserting groove and a second inserting groove, wherein the first inserting groove is configured to receive a mobile phone and the second inserting groove is configured to receive a cup.

6. A folding chair, comprising the rotatable accessory according to claim 3, wherein, the folding chair is provided with an armrest rod; and the second connecting portion is integrated with an edge of the table top to form one piece; a first mounting portion protrudes from the first connecting portion, and the first mounting portion is fixedly connected to the armrest rod.

7. A folding chair, comprising the rotatable accessory according to claim 4, wherein, the folding chair is provided with an armrest rod;

the clamping groove is clamped on the armrest rod; and an inserting column protrudes downward from the inner wall of the clamping groove; an inserting hole is formed on the armrest rod and engaged with the inserting column; wherein when the clamping groove is clamped on the armrest rod, the inserting column is inserted in the inserting hole.

8. The folding chair according to claim 6, wherein, the folding chair comprises two side frames and a linkage mechanism, wherein the two side frames are arranged opposite to each other, and the linkage mechanism is provided between the two side frames; the linkage mechanism is fixedly connected to the two side frames to allow the two side frames to be away from each other and close to each other under an action of an external force;

a left side frame and a right side frame of the two side frames each comprises a first support rod, a second support rod, the armrest rod, and a first connecting rod;

an upper end of the first support rod is fixed to the armrest rod extending backward, and a backrest rod extends upward from an end of the armrest rod, wherein the end of the armrest rod is away from the first support rod;

an upper end of the second support rod is fixedly connected to the backrest rod; and a height of the first connecting rod is lower than a height of the armrest rod; a first end portion of the first connecting rod is fixedly connected to the first support rod, and a second end portion of the first connecting rod extends backward and is fixedly connected to the second support rod.

9. The folding chair according to claim 8, wherein, the linkage mechanism comprises two cross mechanisms; each of the two cross mechanism comprises two first linkage rods, and the two first linkage rods are hinged by a first hinge shaft; the first hinge shaft is located in a middle of the two first linkage rods, and two second linkage rods are hinged on the two first linkage rods, respectively; first end portions of the two second linkage rods are hinged to the two first linkage rods by two second hinge shafts, respectively; wherein, the two second hinge shaft are located on upper ends of the two first linkage rods, and higher than the first hinge shaft;

in one of the left side frame and the right side frames, the first support rod is hinged to a second end portion of the two second linkage rods by a third hinge shaft; the first support rod is further hinged to a lower end of the two first linkage rods by a fourth hinge shaft; the second support rod is hinged to a second end portion of the two second linkage rods by a fifth hinge shaft; the second support rod is further hinged to a lower end of the two first linkage rods by a sixth hinge shaft;

the third hinge shaft is located on the upper end of the first support rod and higher than the fourth hinge shaft, and the fifth hinge shaft is located on the upper end of the second support rod and higher than the sixth hinge shaft; and upper ends of the two first linkage rods hinged on the one of the two side frames are connected by a first horizontal rod.

10. The folding chair according to claim 9, wherein, the left side frame and the right side frame further comprise a support portion;

a third connecting portion is bent upward and fixed to a first end portion of the support portion; the third connecting portion is integrated with the support portion to form one piece; an end of the third connecting portion is fixedly connected to the first connecting rod, wherein the end of the third connecting portion is positioned away from the support portion;

a lower end of the first support rod forms a first support leg, and a lower end of the second support rod forms a second support leg; a second end portion of the support portion extends backward to a rear of the second support leg; and the first support leg and a bottom surface of the support portion are located at one height, and the second support leg abuts on the support portion.

11. The folding chair according to claim 7, wherein, the folding chair comprises two side frames and a linkage mechanism, wherein the two side frames are arranged opposite to each other, and the linkage mechanism is provided between the two side frames; the linkage mechanism is fixedly connected to the two side frames to allow the two side frames to be away from each other and close to each other under an action of an external force;

a left side frame and a right side frame of the two side frames each comprises a first support rod, a second support rod, the armrest rod, and a first connecting rod;

an upper end of the first support rod is fixed to the armrest rod extending backward, and a backrest rod extends upward from an end of the armrest rod, wherein the end of the armrest rod is away from the first support rod;

an upper end of the second support rod is fixedly connected to the backrest rod; and a height of the first connecting rod is lower than a height of the armrest rod; a first end portion of the first connecting rod is fixedly connected to the first support rod, and a second end portion of the first connecting rod extends backward and is fixedly connected to the second support rod.

12. The folding chair according to claim 11, wherein, the linkage mechanism comprises two cross mechanisms; each of the two cross mechanism comprises two first linkage rods, and the two first linkage rods are hinged by a first hinge shaft; the first hinge shaft is located in a middle of the two first linkage rods, and two second linkage rods are hinged on the two first linkage rods, respectively; first end portions of the two second linkage rods are hinged to the two first linkage rods by two second hinge shafts, respectively; wherein, the two second hinge shaft are located on upper ends of the two first linkage rods, and higher than the first hinge shaft;

in one of the left side frame and the right side frames, the first support rod is hinged to a second end portion of the two second linkage rods by a third hinge shaft; the first support rod is further hinged to a lower end of the two first linkage rods by a fourth hinge shaft; the second support rod is hinged to a second end portion of the two second linkage rods by a fifth hinge shaft; the second support rod is further hinged to a lower end of the two first linkage rods by a sixth hinge shaft;

the third hinge shaft is located on the upper end of the first support rod and higher than the fourth hinge shaft, and the fifth hinge shaft is located on the upper end of the second support rod and higher than the sixth hinge shaft; and upper ends of the two first linkage rods hinged on the one of the two side frames are connected by a first horizontal rod.

13. The folding chair according to claim 12, wherein, the left side frame and the right side frame further comprise a support portion;

a third connecting portion is bent upward and fixed to a first end portion of the support portion; the third connecting portion is integrated with the support portion to form one piece; an end of the third connecting portion is fixedly connected to the first connecting rod, wherein the end of the third connecting portion is positioned away from the support portion;

a lower end of the first support rod forms a first support leg, and a lower end of the second support rod forms a second support leg; a second end portion of the support portion extends backward to a rear of the second support leg; and the first support leg and a bottom surface of the support portion are located at one height, and the second support leg abuts on the support portion.

* * * * *